US005347778A

United States Patent [19]

Bray

[11] Patent Number: 5,347,778

[45] Date of Patent: Sep. 20, 1994

[54] PARTITION JOINING SYSTEM

[75] Inventor: James R. Bray, Hendersonville, Tenn.

[73] Assignee: Globe Business Furniture, Inc., Hendersonville, Tenn.

[21] Appl. No.: 43,795

[22] Filed: Apr. 7, 1993

[51] Int. Cl.[5] ..... E04B 2/82

[52] U.S. Cl. ..... 52/239; 52/241; 52/582.1; 160/135

[58] Field of Search ..... 52/239, 241, 582; 160/135, 351

[56] References Cited

U.S. PATENT DOCUMENTS

| | | | |
|---|---|---|---|
| 3,428,108 | 2/1969 | Singer . | |
| 4,035,972 | 7/1977 | Timmons | 52/241 |
| 4,185,430 | 1/1980 | Gartung | 52/239 X |
| 4,250,676 | 2/1981 | Presby . | |
| 4,269,005 | 5/1981 | Timmons | 52/239 X |
| 4,516,619 | 5/1985 | Hasbrouck . | |
| 4,561,229 | 12/1985 | Gartung . | |
| 4,610,560 | 9/1986 | Miller . | |
| 4,624,083 | 11/1986 | Diffrient | 52/239 X |
| 4,637,177 | 1/1987 | Long . | |
| 4,682,457 | 7/1987 | Spencer | 52/239 |
| 4,947,601 | 8/1990 | McGuire . | |
| 4,949,519 | 8/1990 | Jeffers . | |
| 5,209,035 | 5/1993 | Hodges et al. | 52/239 X |

FOREIGN PATENT DOCUMENTS

| | | | |
|---|---|---|---|
| 2234286 | 1/1991 | United Kingdom | 160/351 |

*Primary Examiner*—Carl D. Friedman
*Assistant Examiner*—Kevin D. Wilkens
*Attorney, Agent, or Firm*—Jacobson, Price, Holman & Stern

[57] ABSTRACT

A system for joining partitioning panels is simple to assemble and take down while effectively concealing the inter-panel connections and maintaining visual continuity of the panels. Attachment fittings are provided at the top and bottom corners of each panel and plate-like connector brackets are used to connect the fittings and assemble the panels either in line or at an angle. Snap-on covers are provided for the top attachment fittings which conceal the connector brackets and form a visual continuation of finishing strips which extend along the top edges of the panels.

20 Claims, 6 Drawing Sheets

PARTITION JOINING SYSTEM

BACKGROUND OF THE INVENTION

This invention relates to a system for joining individual partitioning panels together, in situ, for example to form an office or other indoor partition.

In modern day office spaces and other work areas, it is common practice to divide the work area into separate work stations by means of in situ knockdown partitions, commonly made up of individual connectable free-standing or suitably supported panels and the like.

Among the requirements for partitions of the above kind are, inter alia, that the individual panels should be as simple as possible to connect together when erecting a partition and to disconnect when taking down the partition consistent with maintaining the structural integrity and strength of the partition. Also, for aesthetic reasons, it is preferable to be able to conceal any inter-panel connections in the completed partition and generally enhance its overall appearance. The present invention provides a partition joining system directed toward fulfilling these requirements.

SUMMARY OF THE INVENTION

The invention provides a system for releasably joining together individual partitioning panels, in situ, wherein the top corners of each panel are provided with respective attachment fittings for receiving respective ends of plate-like connector brackets used for joining adjacent panels together by attachment to the respective corner fittings of the adjacent panels. Further, the corner fittings at the top corners of the panels each have a snap-on cover, or cap which conceals the connector bracket when the panels are assembled and which at least visually forms a continuation of the panel edging. In the overall system, different connector brackets are provided for joining adjacent panels in line or at right-angles, in the latter case to form angle, T, or cruciform junctions. In each case, the snap-on covers conceal respective ends of the connector brackets, and for T or cruciform junctions, central portions of the connector brackets may have their own integrally formed covers or caps visually integrated with those on the panel corner fittings.

The corner fittings on each panel may include a stand-up threaded post over which an apertured end of a connector bracket is received and tightened down by a nut. The post may be located in a central slotted or recessed portion of the fitting on opposite sides of which are snap-in connector portions for receiving complimentary snap-in connector portions of the cover.

The bottom corners of each panel conveniently have connector fittings similar to those at the top of the panels for receiving similar, inter-panel, plate like connector brackets, but no covers are required.

A partition according to the invention is simple to erect and take down by use of simple wrench-like hand tools for tightening and loosening the nuts associated with each corner fitting and by snapping and unsnapping the respective covers as applicable.

In case of T-junction, right-angle and cruciform inter-panel connections, vertical beading or filler strips and the like may be provided to conceal the panel edges and enhance the appearance of the inter-panel junctions.

Additional features and advantages of the invention will become apparent from the ensuing description and claims read in conjunction with the attached drawings.

DESCRIPTION OF PREFERRED EMBODIMENTS

Figure 1:
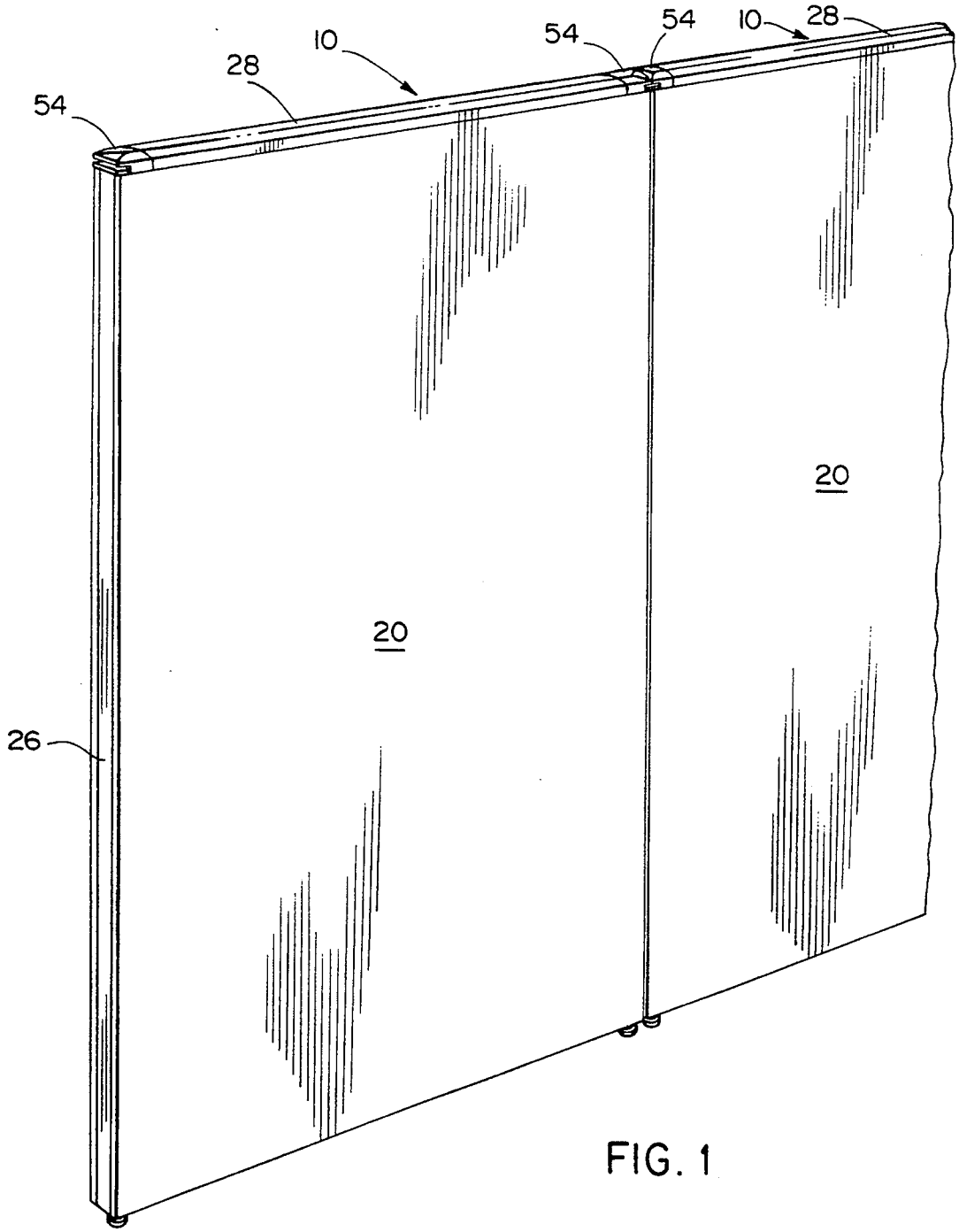
FIG. 1 is a perspective view of a pair of partitioning panels connected together in line by a joining system according to the invention.

A typical partitioning panel 10 to which the present invention is applicable, is shown, for example, in FIGS. 6–10. The panel comprises a rectangular wooden or chipboard frame 12 around which a metal frame 14 of rectangular section tubing lengths welded together is fastened by screws 16 extending through suitable apertures in the metal tubes. The side tubes 18 of the metal frame are open top and bottom. The panel is faced front and back by wooden or chipboard sheets 20 attached by pins 22 to frame 12, the sheets 20 having fabric coverings 24. The side edges of the panel are also provided with fabric covered chipboard or like sheets 26 pinned or otherwise secured between the outer edges of sheets 20. The top edge of the panel is provided with a plastic edging or beading strip 28 with depending legs 30 which snap fit onto the top metal tube of frame 14 (see FIG. 7). The strip 28 terminates at the inner edges of tubes 18.

Figure 13:
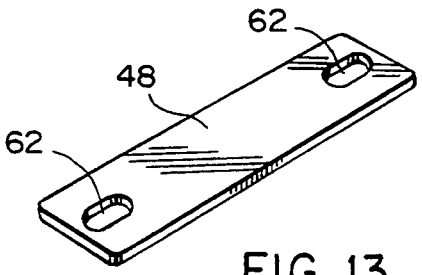
FIG. 13 is a perspective view of a plate-like top connector bracket used for connecting adjacent panels together in line.
Figure 14:
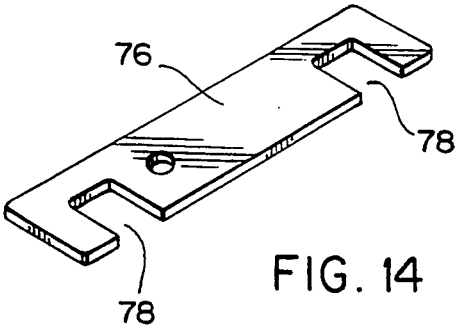
FIG. 14 is a view similar to FIG. 13 of a bottom connector bracket.
Figure 2:
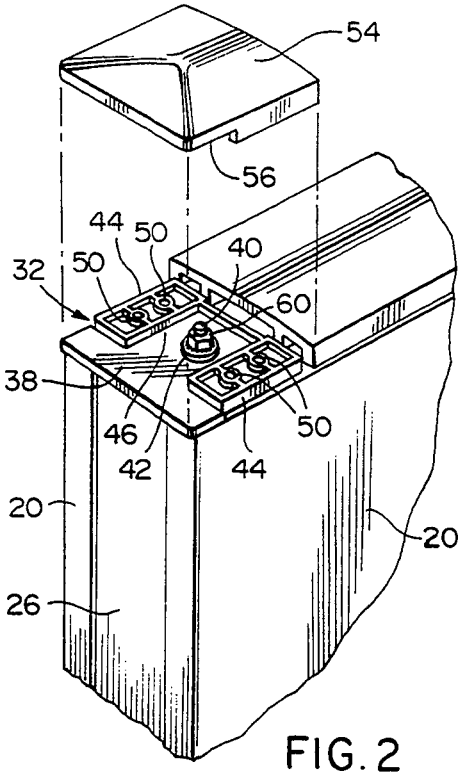
FIG. 2 is an enlarged exploded view of a top corner fitting one of the panels.
Figure 3:
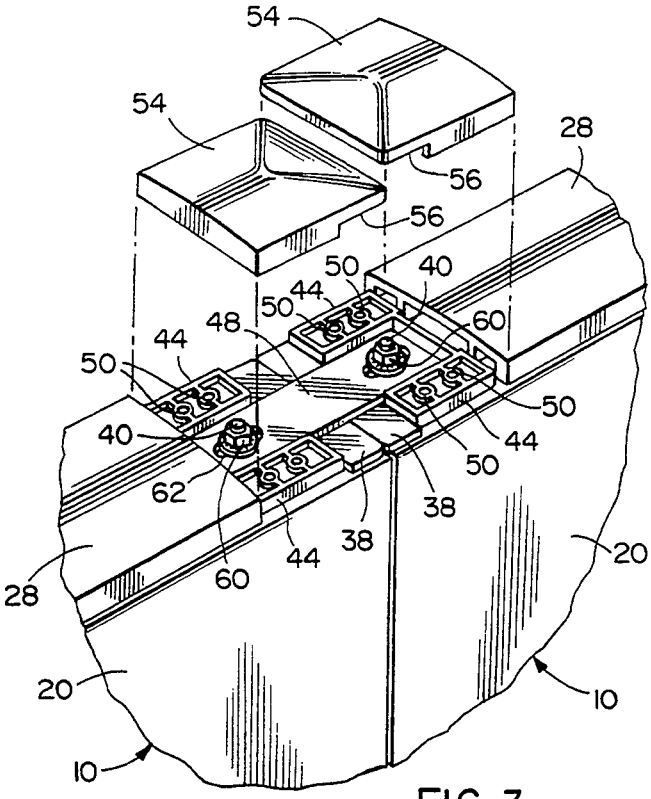
FIG. 3 is a view similar to FIG. 2 showing adjacent corners of a pair of inter connected panels.
Figure 4:
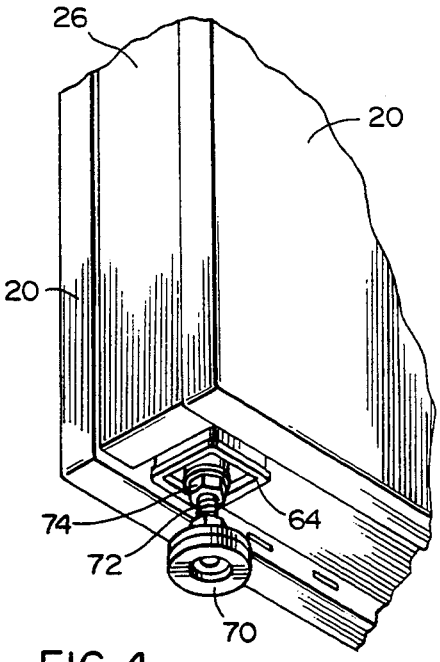
FIG. 4 is a perspective view, from below of a bottom corner of a panel.
Figure 5:
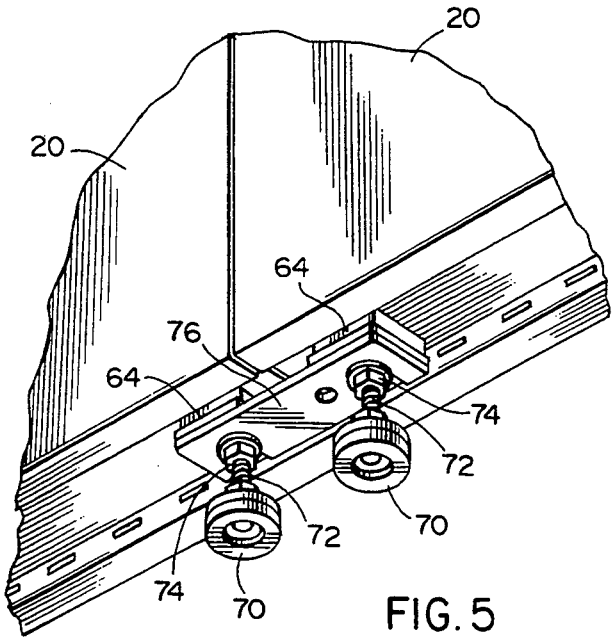
FIG. 5 is a view similar to FIG. 4 showing the bottom corners of a pair of inter-connected panels.
Figure 6:
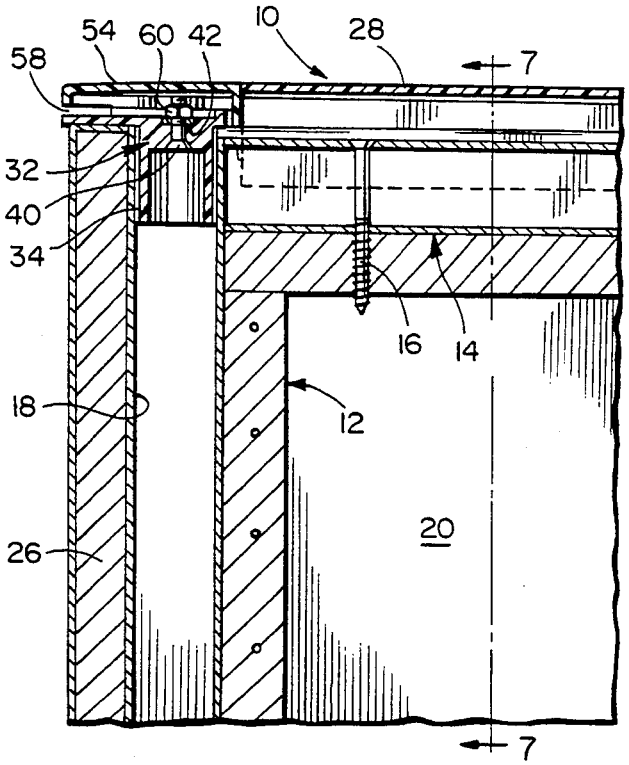
FIG. 6 is a sectional elevational view of the top corner portion of a panel.
Figure 7:
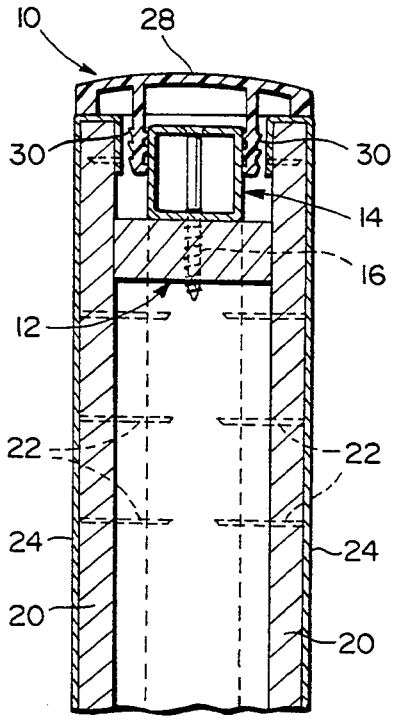
FIG. 7 is a sectional view on line 7—7 of FIG. 6.
Figure 8:
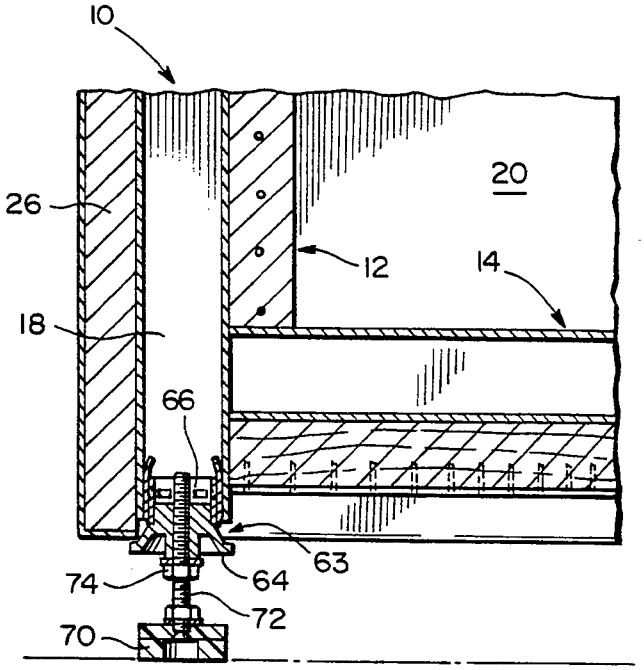
FIG. 8 is a view similar to FIG. 6 of the bottom corner portion of the panel.
Figure 9:
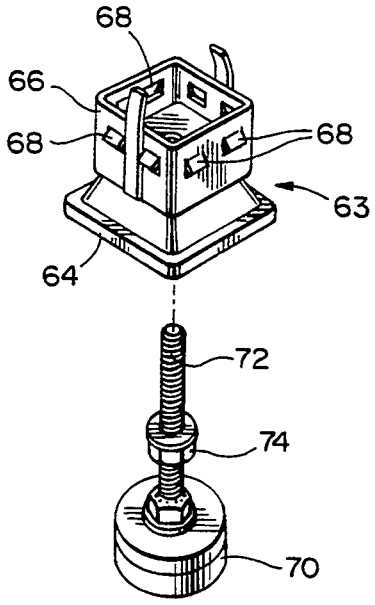
FIG. 9 is an exploded perspective view of a bottom corner fitting for the panel prior to assembly.
Figure 10:
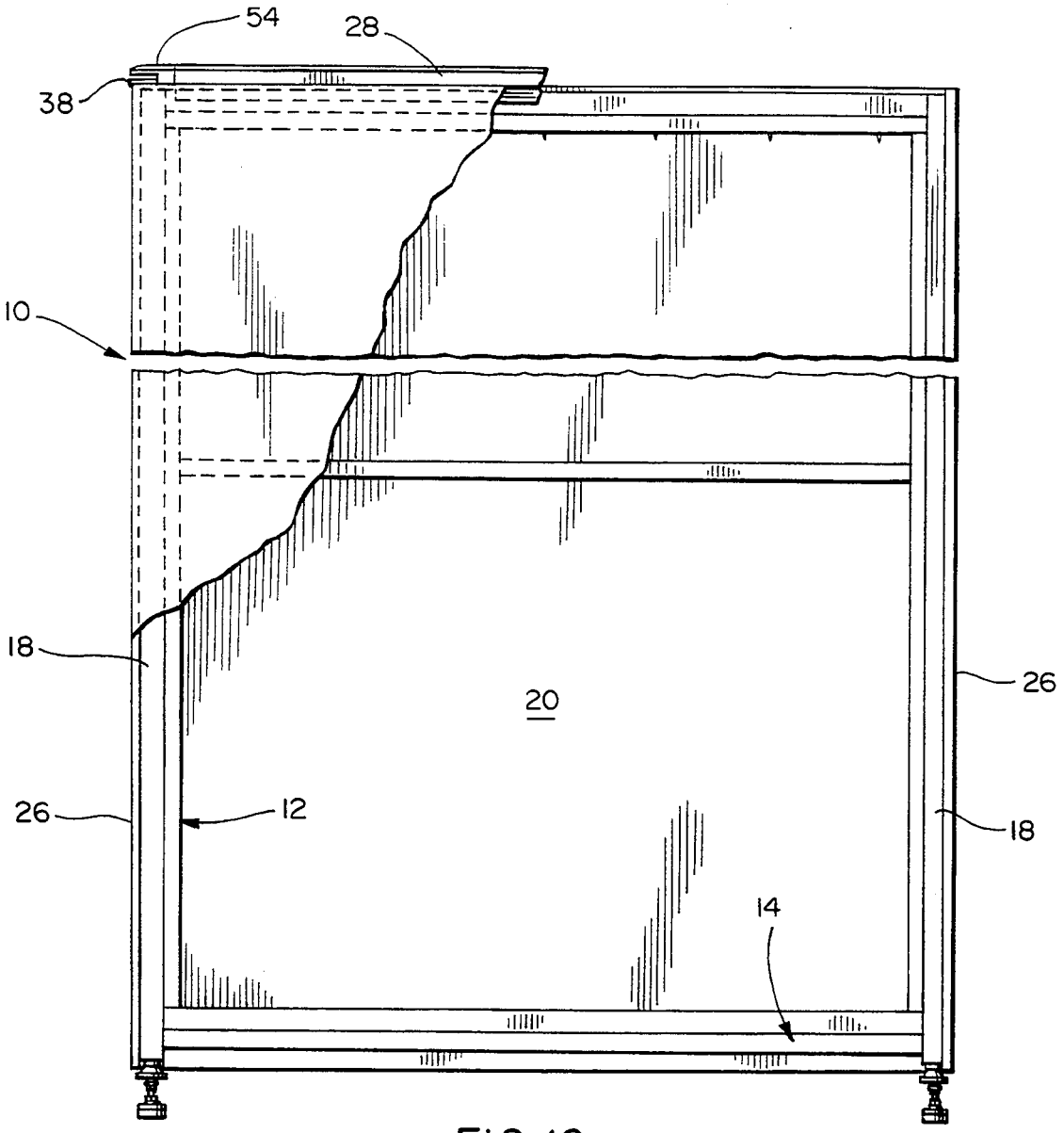
FIG. 10 is a front elevational view of a panel, part broken away.
Figure 11:
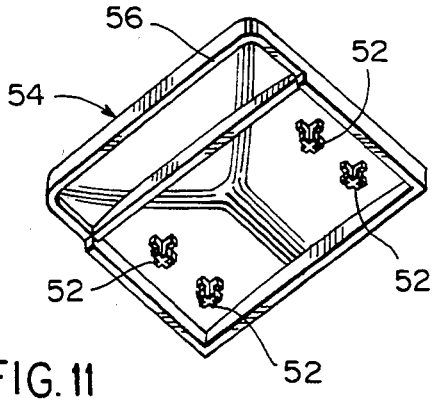
FIG. 11 is an underneath perspective view of a cover for a top corner fitting of a panel.
Figure 12:
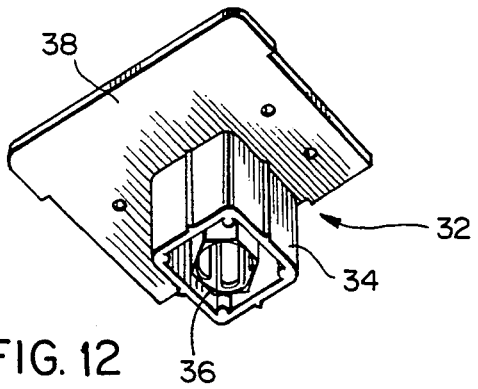
FIG. 12 is an underneath perspective view of the top corner fitting.

Press-fitted into the open top of each tube 18 is a plastic attachment fitting 32, see particularly FIGS. 6 and 12. The fitting has a rectangular outer hub 34 dimensioned to press-fit tightly into tube 18, a hexagonal inner hub 36 and a top flange 38. A bolt 40 is mounted in the inner hub so as to project upwardly somewhat from flange 38, the bolt being secured in place by a lock washer 42. On its upper face, flange 38 is formed with opposed rectangular ribs 44 defining a shallow channel 46 (FIG. 2) therebetween for receiving a plate-like connector bracket 48 as will be described. Within the ribs are circular sockets 50 into which cruciform projections 52 of a plastic cover 54 can be releasably press-fitted. The cover is designed to match beading strip 28 and when fitted on flange 38 forms a visual extension of the beading strip. The cover has a peripheral step 56 at one end to define a slot 58 (FIG. 6) through which connector bracket 48 can extend. To secure the bracket in place, bolt 40 is provided with a nut 60. As shown in FIG. 13, bracket 48 has slots 62 at its opposite ends to fit over the respective bolts 40 at the top corners of two adjacent panels. The width of the bracket substantially conforms to the width of channel 46.

Press-fitted into the bottom of each tube 18 is a metal fitting 63 of known kind having, for example, a base portion 64 of zinc plate and a top 66 of spring steel with gripping projections 68. A levelling glide 70 threads into the fitting in known manner. The threaded stem 72 of the glide is provided with a nut and washer assembly for securing a bottom connector bracket 76 onto the adjacent stems 72 and tightening up the assemblies 74, again by means of a simple hand wrench. To disconnect the panels, this simple procedure is reversed.

Figure 15:
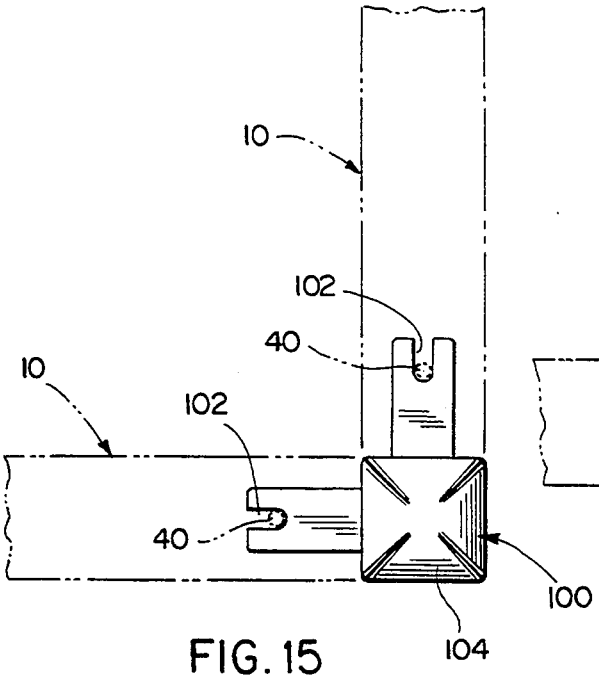
FIG. 15 is a plan view of a top connector bracket for connecting panels, shown in phantom at right angles.
Figure 16:
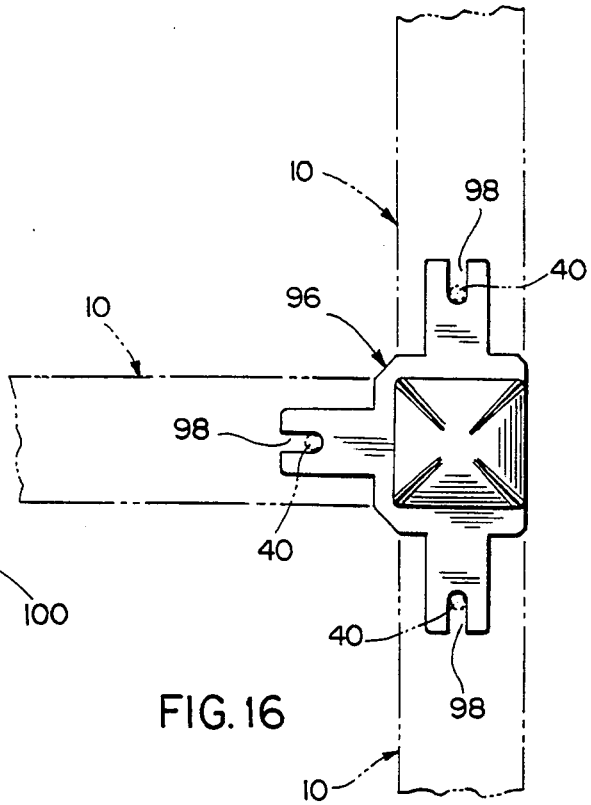
FIG. 16 is a view similar to FIG. 15 of a top connector bracket for connecting three panels together at a T-junction.
Figure 22:
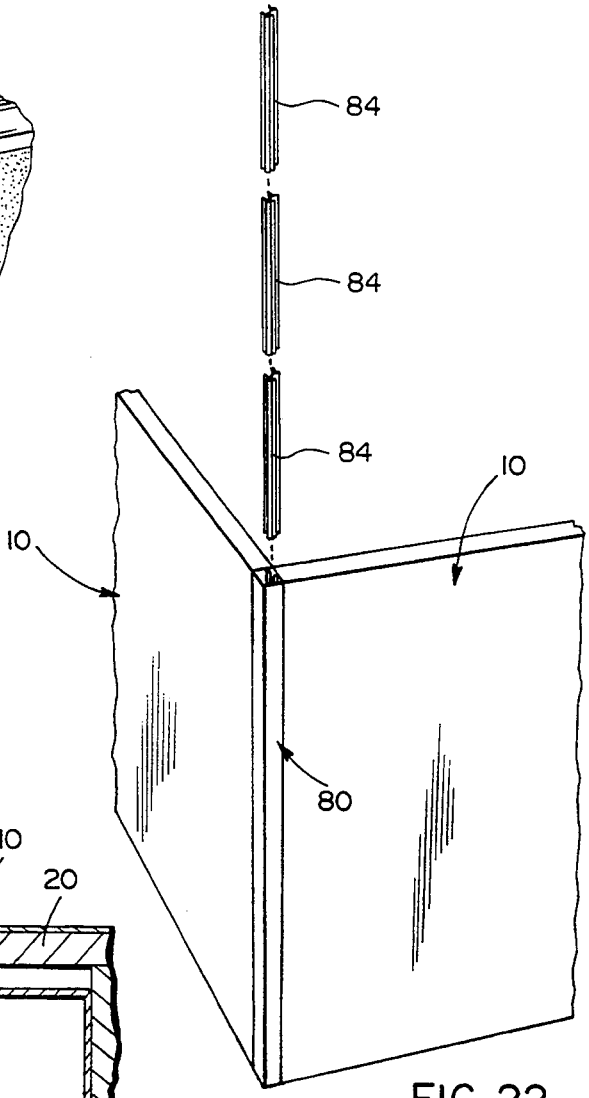
FIG. 22 is a perspective view of a pair of panels connected at a right angle and showing a beading channel and connector strip (exploded)
Figure 23:
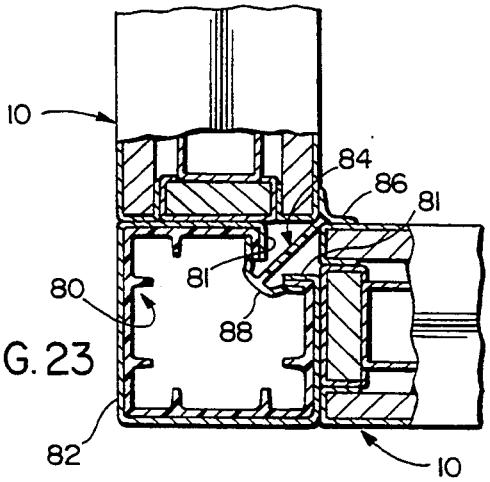
FIG. 23 is a sectional plan view of the connection between panels as shown in FIG. 22.

FIGS. 15, 22 and 23 show an arrangement in which a pair of panels 10 as previously described are connected at a right angle rather than in line. As shown in FIG. 23, the panels are disposed corner edge to corner edge, and a hollow plastic filler strip 80, covered in fabric 82 to match that on the panels is used to fill the corner gap. To hold the filler strip in place, extruded plastic key strips 84 are inserted between the panels, the key strips having barbed ends 86, 88 which engage behind the panels, and behind the opposed lips 81 of the filler strip. In place of the connector brackets 48 used to connect the panels in line, in this case an angled connector bracket 100 (FIG. 15) is used to connect the top corners of the panels. Bracket 100 has apertures 102 in the respective limbs to engage bolts 40 of the respective panels in like manner to the apertures 62 in bracket 48 as previously described. In this case, the central portion of bracket 100 has an integrally attached plastic cover 104 to match visually with the covers 54 on the adjacent panels. Angled bottom brackets (not shown) are provided to replace the previously described brackets 76, and the panels are connected together and taken apart in like manner to the in-line panels previously described.

Figure 18:
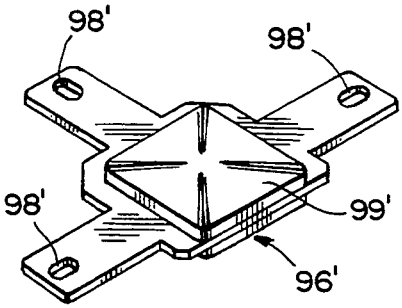
FIG. 18 is a perspective view of another connector bracket for connecting three panels together at a T-junction.
Figure 20:
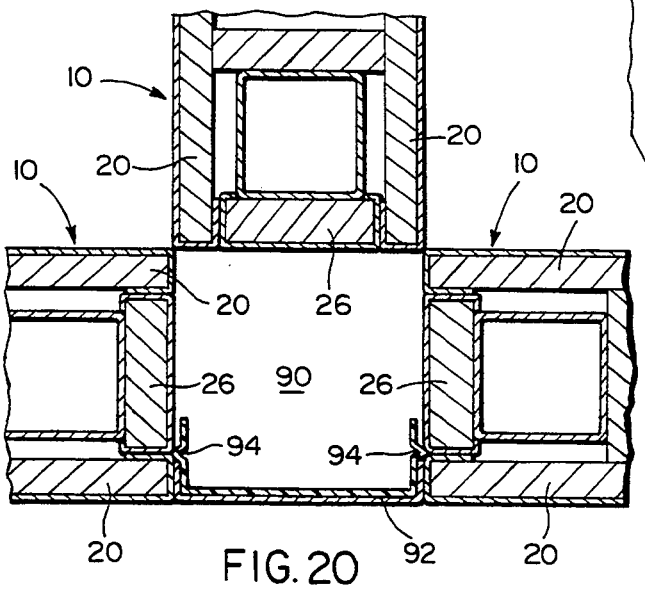
FIG. 20 is a sectional view on line 20—20 of FIG. 19.
Figure 21:
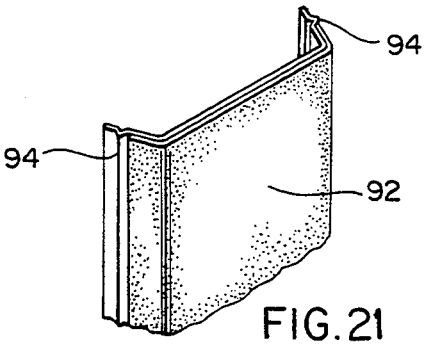
FIG. 21 is a perspective view of part of a beading strip used in the arrangement shown in FIGS. 19 and 20.

FIGS. 16 and 18–21 show an arrangement for connecting together three of the panels 10 at a T-junction. As seen in FIG. 20, the panels are located corner edge to corner edge, leaving a rectangular space 90 therebetween. A fabric covered extruded cover strip 92 is used to enclose the space 90, the strip having resilient end portions with ridges 94 that seat in small gaps defined between the sheets 20 and 26 of the respective panels 10. A T-shaped attachment bracket 96 with apertures 98 in its respective limbs and a central plastic cover 99 is used to attach the top corners of the respective panels in like manner to the brackets 48 and 100 previously described. A similarly shaped bracket (not shown) is used for connecting the bottom corners of the panels. A modified top bracket 96' with enclosed apertures 98' is shown in FIG. 18.

Figure 17:
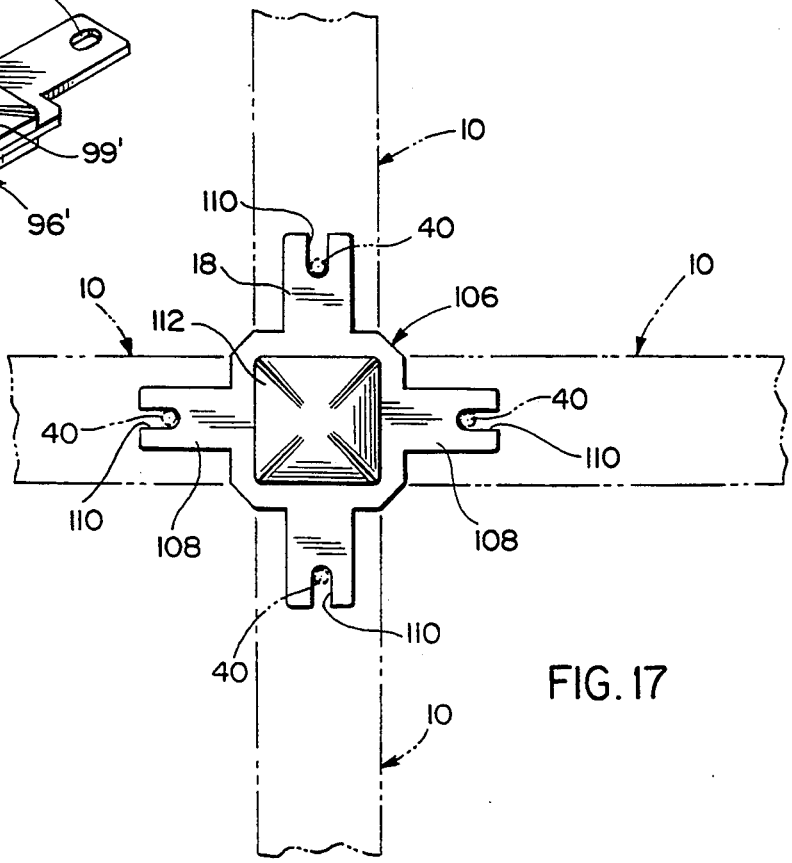
FIG. 17 is a view similar to FIG. 16 of a top connector bracket for connecting four panels together at a cruciform junction.
Figure 19:
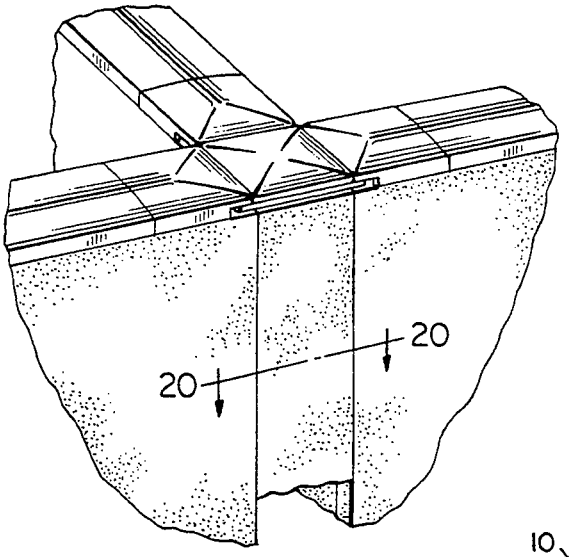
FIG. 19 is a perspective view of a top corner connection between three panels using a connector bracket as shown in FIG. 18.

FIG. 17 shows an arrangement of four panels 10 interconnected in a cruciform formation using a top connector bracket 106 with four arms 108, apertures 110 and a central cover 112 which is used in the same way as those previously described in conjunction with a similarly shaped bottom connector bracket, not shown.

In each case, the invention provides an extremely simple to use, connection system for partitioning panels wherein the inter-panel connectors are effectively concealed and wherein the aesthetic appearance of the panels is maintained in the connected assembly.

While only preferred embodiments of the invention have been described in detail, the invention is not limited thereby and modifications can be made within the scope of the attached claims.

I claim:

1. A partition joining system comprising a plurality of rectangular partitioning panels each having top and bottom edge, top and bottom corners, a first attachment fitting on each top corner, a second attachment fitting on each bottom corner, and an edging means extending along the top edge of the panel and terminating at said first attachment fittings, the system further including a plurality of plate-like top connector brackets, each top connector bracket for releasably attaching to the first attachment fittings of a pair of adjacent panels to connect the top corners of the panels together and a plurality of bottom connector brackets, each bottom connector bracket for releasably attaching to the second attachment fittings of a pair of adjacent panels to connect the bottom corners of the panels together and wherein the panels further include a removable cover for each first attachment fitting adapted to fit onto the attachment fitting over a top connector bracket and form a visual extension of said edging means when a pair of panels are connected together as aforesaid, wherein each panel includes a frame having side tubes open at the top and bottom edges of the panel, wherein the first attachment fittings and the second attachment fittings each are a press fit in a respective end of one of said tubes, and wherein each first attachment fitting comprises a hub portion fitted in a respective open end of one of said tubes, a flange portion at the top edge of the panel adjacent said edging means, attachment means on said flange for a top connector bracket and connector means on said flange for the respective cover.

2. A system as claimed in claim 1, wherein the attachment means comprises a bolt projecting from said flange and wherein the top connector brackets have respective ends with apertures for engaging over the respective bolts.

3. A system as claimed in claim 2, wherein the flange of each first attachment fitting includes ridges on opposite sides of the bolt defining a channel therebetween to receive a respective top connector bracket.

4. A system as claimed in claim 3, wherein the connector means on each said flange comprises snap-in fittings located on opposite sides of said channel and wherein the respective covers have complimentary internal snap-in fittings and a stepped peripheral wall defining a slot to accommodate a top connector bracket.

5. A system as claimed in claim 1, wherein the second attachment fittings each include an adjustable glide with a threaded stem for levelling the panels in situ, and wherein the bottom connector brackets comprise connector plates with apertures to be received on the stems of adjacent fittings, each stem further including a nut for tightening a connector plate against a body portion of the respective attachment fitting.

6. A system as claimed in claim 1, wherein said top and bottom connector brackets include at least one linear top connector bracket and at least one linear bottom connector bracket for connecting a pair of panels together in line and edge to edge.

7. A system as claimed in claim 1, wherein said top and bottom connector brackets include at least one angled top connector bracket and at least one correspondingly angled bottom connector bracket for connecting a pair of adjacent panels together at a right angle along a vertical line at inner corner edges of the respective panels wherein a rectangular-shaped vertically extending gap is formed between adjacent vertical edges of the panels, further wherein the system includes a profiled filler strip for positioning in said gap, and slide-in key strip means for attaching the filler strip to the panels and further wherein the angled top connector bracket includes an integral cap to fit over the top of said gap and form a visual bridge between the respective covers and edging means of the adjacent panels.

8. A system as claimed in claim 1, wherein said top and bottom connector brackets include at least one T-shaped top connector bracket and at least one T-shaped bottom connector bracket for connecting three of the panels together at a T-junction with a vertically extending rectangular gap formed between adjacent vertical edges of the panels wherein the system further includes a vertical profile strip for closing said gap and wherein the T-shaped top connector bracket has an integral central cap for covering said gap and forming a visual bridge between the respective covers and edging means of the adjacent panels.

9. A system as claimed in claim 8, wherein the profile strip has vertically extending ridges adapted to fit resiliently in vertical slots in opposite side edges of a pair of said panels to hold the profile strip in place.

10. A system as claimed in claim 1, wherein said top and bottom connector brackets include at least one cruciform top connector bracket and at least one cruciform bottom connector bracket for connecting four of the panels together in a cruciform configuration with a rectangular vertical gap formed between adjacent vertical edges of the panels, and wherein the cruciform top connector bracket has an integral central cap for covering said gap and forming a visual bridge between the covers and edging means of the adjacent panels.

11. A system as claimed in claim 1, wherein the edging means comprise a plastic edging strip and the covers comprise plastic covers having a profile conforming to the profile of the edging strip.

12. A system as claimed in claim 1, wherein the edging means comprises a plastic edging strip having depending limbs gripping a top tube of said flame therebetween.

13. A rectangular partitioning panel having top and bottom edges, top and bottom corners, a first attachment fitting on each top corner, a second attachment fitting on each bottom corner, edging means extending along the top edge of the panel and terminating at the respective first attachment fittings, first attachment means on each first attachment fitting for receiving a plate-like top connector bracket for attaching top corners of a pair of adjacent panels together, second attachment means on each second attachment fitting for receiving a bottom connector bracket for attaching bottom corners of the panels together, and a detachable cover for each first attachment fitting adapted to fit on the attachment fitting over a top connector bracket and form a visual extension of the edging means, wherein each first attachment fitting comprises a top flange adjacent said edging means, wherein the first attachment means comprises a bolt projecting from the flange and wherein the flange includes connection means on opposite sides of the bolt for receiving complimentary snap-in connection means located internally on the respective cover.

14. A panel as claimed in claim 13, wherein the panel has a frame including top tubes and side tubes, wherein the edging means comprises an edging strip having depending limbs embracing the top tube, wherein the side tubes are open top and bottom and wherein the respective first and second attachment fittings are fitted in the open tops and bottoms of the side tubes.

15. A panel as claimed in claim 13, including ridge means on opposite sides of said bolt defining a channel for receiving a top connector bracket and wherein the respective cover includes a stepped periphery defining a slot to accommodate the bracket.

16. A panel as claimed in claim 15, wherein each second attachment fitting includes a level-adjusting glide on a threaded stem which forms the second attachment means.

17. A partition joining system comprising a plurality of rectangular partitioning panels each having top and bottom edges, top and bottom corners, a first attachment fitting on each top corner, a second attachment fitting on each bottom corner, and an edging means extending along the top edge of the panel and terminating at said first attachment fittings, the system further including a plurality of plate-like top connector brackets, each top connector bracket for releasably attaching to the first attachment fittings of a pair of adjacent panels to connect the top corners of the panels together and a plurality of bottom connector brackets, each bottom connector bracket for releasably attaching to the second attachment fittings of a pair of adjacent panels to connect the bottom corners of the panels together and wherein the panels further include a removable cover for each first attachment fitting adapted to fit onto the attachment fitting over a top connector bracket and form a visual extension of said edging means when a pair of panels are connected together as aforesaid, wherein each first attachment fitting comprises a flange portion at the top edge of the panel adjacent said edging means, attachment means on said flange for a top connector bracket and connector means on said flange for the respective cover, wherein the connector means on each said flange comprises snap-in fittings and wherein the respective covers have complimentary internal snap-in fittings and a stepped peripheral wall defining a slot to accommodate a top connector bracket.

18. A system as claimed in claim 17, wherein the attachment means comprises a bolt projecting from said flange and wherein the top connector brackets have respective ends with apertures for engaging over the respective bolts.

19. A system as claimed in claim 18, wherein the flange of each first attachment fitting includes ridges on opposite sides of the bolt defining a channel therebetween to receive a respective top connector bracket.

20. A system as claimed in claim 17, wherein the second attachment fittings each include an adjustable glide with a threaded stem for levelling the panels in situ, and wherein the bottom connector brackets comprise connector plates with apertures to be received on the stems of adjacent fittings, each stem further including a nut for tightening a connector plate against a body portion of the respective attachment fitting.

* * * * *